US010242814B2

(12) United States Patent
Hertzog et al.

(10) Patent No.: US 10,242,814 B2
(45) Date of Patent: Mar. 26, 2019

(54) ELECTRIC ARC EXTINCTION CHAMBER

(71) Applicant: SOCOMEC, Benfeld (FR)

(72) Inventors: Jérôme Hertzog, Benfeld (FR); Karine Coquil, Flexbourg (FR)

(73) Assignee: SOCOMEC, Benfeld (FR)

( * ) Notice: Subject to any disclaimer, the term of this patent is extended or adjusted under 35 U.S.C. 154(b) by 43 days.

(21) Appl. No.: 15/521,373

(22) PCT Filed: Oct. 20, 2015

(86) PCT No.: PCT/FR2015/052806

§ 371 (c)(1),
(2) Date: Apr. 24, 2017

(87) PCT Pub. No.: WO2016/062959

PCT Pub. Date: Apr. 28, 2016

(65) Prior Publication Data

US 2017/0309417 A1 Oct. 26, 2017

(30) Foreign Application Priority Data

Oct. 22, 2014 (FR) ..... 14 60149

(51) Int. Cl.
*H01H 9/34* (2006.01)
*H01H 9/36* (2006.01)
(Continued)

(52) U.S. Cl.
CPC ..... *H01H 9/362* (2013.01); *H01H 3/08* (2013.01); *H01H 9/346* (2013.01); *H01H 9/443* (2013.01); *H01H 9/345* (2013.01); *H01H 9/46* (2013.01); *H01H 2009/347* (2013.01); *H01H 2009/367* (2013.01)

(58) Field of Classification Search
CPC ..... H01H 9/362; H01H 9/346; H01H 9/443; H01H 3/08; H01H 2003/506; H01H 33/182; H01H 2009/347; H01H 2009/367
USPC ... 218/100, 15, 22, 23, 26, 34, 81, 103–105, 218/30, 31, 36
See application file for complete search history.

(56) References Cited

U.S. PATENT DOCUMENTS 4,237,355 A * 12/1980 Fechant ..... H01H 9/446 218/148
7,541,902 B2 * 6/2009 Domejean ..... H01H 9/346 335/201

(Continued)

OTHER PUBLICATIONS

International Search Report from PCT Application No. PCT/FR2015/052806, dated Jan. 4, 2016.

(Continued)

*Primary Examiner* — Edwin A. Leon
*Assistant Examiner* — William A Bolton
(74) *Attorney, Agent, or Firm* — Workman Nydegger

(57) ABSTRACT

An electric arc extinction chamber comprises a stack of electric arc splitter plates. The splitter plates define an inlet of the extinction chamber that is to be present facing electric contacts, and a back of the extinction chamber. At least one permanent magnet is present inside the extinction chamber in a central zone in the width direction of the extinction chamber and beside the back thereof. The magnet presents magnetization having a non-zero component along an axis extending between the inlet and the back of the extinction chamber.

19 Claims, 6 Drawing Sheets

(51) Int. Cl.

| | |
|---|---|
| ***H01H 9/44*** | (2006.01) |
| ***H01H 9/46*** | (2006.01) |
| ***H01H 3/08*** | (2006.01) |

(56) References Cited

U.S. PATENT DOCUMENTS

| | | | | |
|---|---|---|---|---|
| 8,222,983 | B2 * | 7/2012 | Zhou | H01H 9/443 335/201 |
| 2010/0258531 | A1 * | 10/2010 | Bresciani | H01H 9/36 218/151 |
| 2012/0261382 | A1 * | 10/2012 | Fasano | H01H 9/443 218/23 |
| 2013/0112655 | A1 | 5/2013 | Theisen et al. | |
| 2013/0222088 | A1 | 8/2013 | Kashiwagi et al. | |
| 2013/0284702 | A1 | 10/2013 | Hamada et al. | |
| 2014/0061160 | A1 * | 3/2014 | Juds | H01H 9/443 218/26 |
| 2014/0166620 | A1 * | 6/2014 | Gerving | H01H 33/18 218/22 |

OTHER PUBLICATIONS

French Search Report from FR Application No. 1460149, dated Jun. 10, 2015.

* cited by examiner

ELECTRIC ARC EXTINCTION CHAMBER

BACKGROUND OF THE INVENTION

The invention relates to the field of chambers and devices for extinguishing electric arcs.

Circuit breaker devices for low voltages (U_AC≤1000 volts (V) and U_DC≤1500V), generally enable an electric arc to be extinguished in air. The advantage of this technique compared with extinguishing the arc in a vacuum, in sulfur hexafluoride ($SF_6$), or in oil, or indeed compared with devices making use of an insulated gate bipolar transistor (IGBT), lies in being simple to fabricate and use, and consequently in being of low cost.

Breaking current on a direct current (DC) electricity network necessarily involves generating a back electromotive force (emf) of potential that is greater than the potential of the source to be interrupted. This is the major difficulty for breaking DC. In the context of techniques for breaking in air, the electric arc generated when opening the switch in air is used as means for generating a back emf.

The main techniques of breaking in air are discussed below.

The arc lengthening technique serves to lengthen and thus cool the arc while opening the switch. Nevertheless, this principle can be found to have poor performance on overload.

The technique of lengthening and splitting the arc combines lengthening the arc with splitting it in an extinction chamber. Depending on the current to be broken, it is possible that splitting might not come into effect and there can exist critical levels of current for which the arc stagnates at the inlet to the chamber. This principle has the advantage of behaving well on overload since the splitter plates support the arc and enable it to be cooled effectively.

The technique of lengthening by magnetic blowout uses a permanent magnet that tends to blow the arc out magnetically. Such magnetic blowout lengthens the arc to a great extent and cools it effectively. Nevertheless, this extinction principle can be limited at high currents since the cooling of the arc can be degraded as a result of lengthening being less effective at such a level of current.

Furthermore, and by way of example, extinction can be made more difficult in the field of photovoltaic (PV) installations because the panels being used deliver voltages that increase from year to year in order to reduce the costs of such installations. In the content of such applications, it is known to connect a plurality of switches in series in order to increase the breaking capacity of the resulting device. Nevertheless, that solution is not entirely satisfactory.

Other applications, e.g. in the railway field, can also require the use of devices having considerable breaking capacity on a DC network so as to enable overload voltages to be broken.

It is thus desirable to improve existing electric arc extinction devices by improving their arc extinction capacity. It is also desirable to obtain circuit breaker devices that can be used for splitting an electric arc generated after passing a direct current or an alternating current between electrical contacts.

There thus exists a need to have novel extinction chambers and novel breaker devices presenting improved circuit-breaking capacity.

There also exists a need to have novel breaker devices suitable for facilitating penetration of an electric arc into the depth of the extinction chamber.

There also exists a need to have novel breaker devices and novel extinction chambers capable of splitting an electric arc after a direct current or an alternating current has been flowing between electrical contacts.

OBJECT AND SUMMARY OF THE INVENTION

To this end, in a first aspect, the invention provides an electric arc extinction chamber comprising:

- a stack of electric arc splitter plates, the splitter plates defining an inlet of the extinction chamber that is to be present facing electric contacts, and a back of the extinction chamber; and
- at least one permanent magnet present inside the extinction chamber in a central zone in the width direction of the extinction chamber and beside its back, the magnet presenting magnetization having a non-zero component along an axis extending between the inlet and the back of the extinction chamber.

The central zone in the width direction of the extinction chamber corresponds to the zone of the inside of the extinction chamber defined by planes of equation $x_a$=0.25L and $x_b$=0.75L, where L designates the width of the extinction chamber and where $x_a$ and $x_b$ are measured along the width of the extinction chamber, taking one of the ends of the splitter plates as the origin.

The magnet is also situated beside the back of the extinction chamber, i.e. the magnet is closer to the back of the extinction chamber than to the inlet of the extinction chamber, and the magnet generates a magnetic field of intensity that increases on going from the inlet towards the back of the extinction chamber.

The invention advantageously makes it possible to provide extinction chambers presenting improved extinction capacity.

In an embodiment, the magnet may be held in an electrically insulated magnet support.

In an embodiment, the magnet support may be assembled by engagement with one or more splitter plates.

Such a characteristic is advantageous since it makes it possible to place the magnet as close as possible to the back of the extinction chamber and for the magnet to have a stationary position relative to the splitter plates.

In an embodiment, the extinction chamber may further include a flux channeling element present inside the extinction chamber.

The flux channeling element is constituted at least in part by a magnetic part extending towards the inlet of the extinction chamber, e.g. a part of elongate shape.

The presence of a flux channeling element is advantageous since it contributes to "stretching" a maximum of the magnetic field line generated by the magnet towards the inlet of the extinction chamber. The flux channeling element thus serves to further improve the attraction of an electric arc towards the back of the extinction chamber.

The flux channeling element may be placed facing the magnet.

The flux channeling element may be held in the magnet support, and for example it may be in contact with the magnet. Nevertheless, as can be seen from the description below, such a configuration is not essential.

Preferably, the extinction chamber is symmetrical about a plane of equation x=0.5L, where L designates the width of the extinction chamber and where x is measured along the width L of the extinction chamber, taking one of the ends of the splitter plates as the origin.

Such a configuration is advantageous since it makes it possible to have an extinction chamber of extinction capacity that is unaffected by the direction in which the electric arc moves when the contacts open or by the polarity with which the breaker device is connected.

This configuration is particularly advantageous with DC because it is invariant relative to the polarity with which the breaker device is connected.

In an embodiment, the height of the magnet may be greater than or equal to half the height of the stack of splitter plates. Under such circumstances, the height of the magnet may be less than, or equal to, or greater than the height of the stack of splitter plates. In a variant, the height of the magnet may be less than half the height of the stack of splitter plates.

In an embodiment, a single magnet may be present inside the extinction chamber.

In a variant, a plurality of permanent magnets may be present inside the extinction chamber, at least one magnet of said plurality of magnets being present in the central zone in the width direction of the extinction chamber and beside its back. Under such circumstances, the magnets of this plurality of magnets may optionally be in contact with one another. The magnets of the plurality of magnets may have the same magnetization direction, but that is not essential. In an embodiment, the majority, or even all, of the magnets in this plurality of magnets may be present in the central zone in the width direction of the extinction chamber and beside its back.

In an embodiment, the extinction chamber may include one or more electrically insulating electric arc guide cheeks, the guide cheeks being situated at the inlet of the extinction chamber and covering the ends of the splitter plates in full or in part.

The presence of one or more guide cheeks is advantageous insofar as they serve to prevent the arc from attaching to the ends of the splitter plates, thereby further improving extinction performance by increasing the lengthening of the arc and thus the voltage of the arc.

In an embodiment, the guide cheek(s) may be secured to the magnet support, and for example they may be made integrally therewith.

The present invention also provides a circuit breaker device comprising:

an extinction chamber as defined above; and a contact zone in which there are present at least one stationary contact and at least one movable contact that is movable relative to the stationary contact, the contacts being suitable for being put into contact with each other and for being separated from each other, the stationary contact being present facing the inlet of the extinction chamber.

In an embodiment, the movable contact may be configured to move in rotation about an axis of rotation while the contacts are being separated.

In an embodiment, the device may further include an arcing horn present facing the stationary contact, the width of the arcing horn being greater than the width of the stationary contact.

Because of the presence of the permanent magnet in the extinction chamber, an arc generated between the contacts tends to have a non-zero movement component along the width of the extinction chamber. Thus, e.g. when the movable contact is moved in rotation about an axis of rotation while the contacts are separating, the arc that is generated tends to be deflected with a non-zero component along the axis of rotation. It is thus important for the arcing horn to be wider than the stationary contact so that while the arc is being deflected along the width of the extinction chamber, it can become "attached" to the arcing horn. Using an arcing horn can advantageously help in splitting the electric arc by facilitating entry of the arc into the extinction chamber. Specifically, the electric arc generated between the contacts under such circumstances tends to move from the stationary contact towards the arcing horn and thus to come closer to the back of the extinction chamber. Another advantage associated with using an arcing horn is reducing the erosion of the stationary contact due to the arc as a result of limited contact between the arc and the stationary contact.

In an embodiment, the height of the arcing horn may be greater than or equal to the height of the stationary contact.

In an embodiment, the movable contact may be configured to move in rotation about an axis of rotation when the contacts are being separated, and a flux channeling element may be present inside the extinction chamber, the flux channeling element having a face situated beside the contact zone that, when the flux channeling element is observed in a plane perpendicular to the axis of rotation, presents the same shape as the path followed by the movable contact during separation of the contacts.

Such a configuration is advantageous since in makes it possible to conserve a constant distance between the flux channeling element and the movable contact while the contacts are separating, thereby further improving the attraction of the arc into the extinction chamber.

In an embodiment, the device may further include a flux channeling element present inside the extinction chamber, at least a portion of the flux channeling element being constituted by an arc switching element present facing the stationary contact, the width of the arc switching element being greater than the width of the stationary contact.

In an embodiment, the flux channeling element may include an arc switching element together with an additional flux channeling element present in an electrically insulating channeling element support.

Such configurations are advantageous since they make it possible to have simultaneously the effect of magnetic field lines generated by the magnet being "stretched" towards the inlet of the extinction chamber and assistance in causing the arc to enter into the extinction chamber because of using the arc switching element.

The device of the invention makes it possible to extinguish an electric arc generated after passing DC or an alternating current (AC) between the contacts.

BRIEF DESCRIPTION OF THE DRAWINGS

Other characteristics and advantages of the invention appear from the following description of particular embodiments of the invention given as non-limiting examples and with reference to the accompanying drawings, in which.

DETAILED DESCRIPTION OF EMBODIMENTS

Figure 1:
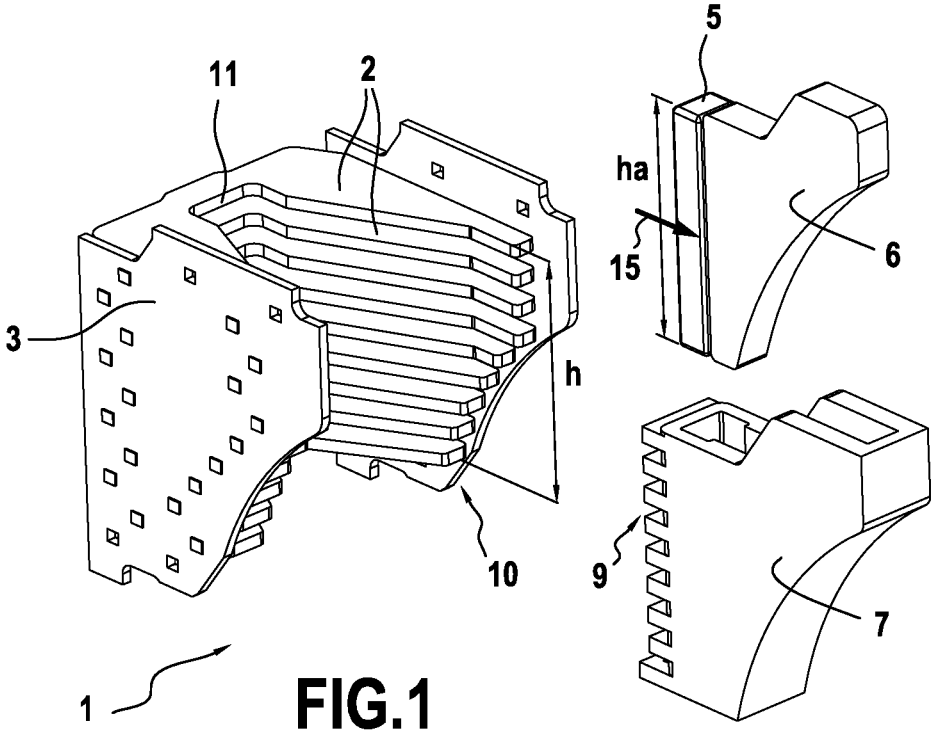
FIG. 1 is an exploded view of an arc extinction chamber of the invention.

FIG. 1 is an exploded view of an arc extinction chamber 1 of the invention. The extinction chamber 1 comprises a stack of electric arc splitter plates 2 mounted on a plate support 3. Mounting splitter plates 2 on the plate support 3 makes it possible to form an extinction chamber 1 that is rigid. The splitter plates 2 are made of mild steel, for example. By way of example, the plate support 3 may be made of vulcanized card. In a variant, the splitter plates 2 may be mounted directly on the box constituting the outer housing of the circuit breaker device. The extinction chamber 1 shown in FIG. 1 has a plurality of stacked splitter plates 2, e.g. at least three stacked splitter plates 2, e.g. at least five stacked splitter plates 2. The height h of the stack of splitter plates 2 corresponds to the distance between the two splitter plates that are the furthest apart. In the example shown, the height h of the stack of splitter plates 2 is measured perpendicularly to the splitter plates 2. The extinction chamber 1 has an inlet 10 and a back 11 situated remote from the inlet defined by the splitter plates 2. In addition to the splitter plates 2, a permanent magnet 5 is present inside the extinction chamber 1. By way of example, the magnet 5 is made of NdFeB. As shown, the magnet 5 is present in an electrically insulating magnet support 7 that is present inside the extinction chamber 1. The magnet 5 may be in the form of a bar, as shown in FIG. 1. By way of example, the bar may have a cross-section that is rectangular, square, or circular. As shown, the magnet 5 does not extend along the planes in which the splitter plates 2 extend, but along the height h of the stack of splitter plates 2. In the example shown, the magnet 5 extends along a height $h_a$, as measured along the height h of the stack of splitter plates 2, that is greater than or equal to 50% of the height h of the stack of splitter plates 2. By way of example, the height $h_a$ of the magnet 5 is greater than or equal to 75% of the height h of the stack of splitter plates, the height $h_a$ of the magnet 5 being substantially equal to the height h of the stack of splitter plates, for example. Nevertheless, the height of the magnet is not limited to the configuration shown in FIG. 1. Specifically, the magnet may present a height that is greater than the height of the stack of splitter plates. In a variant, the magnet may present a height that is less than the height of the stack of splitter plates. For example, the magnet may present a height that is less than half the height of the stack of splitter plates, and under such circumstances the magnet may be present solely in the bottom portion of the extinction chamber.

By way of example, and as shown, a single magnet 5 is present inside the extinction chamber 1, however it would not go beyond the ambit of the invention for a plurality of magnets to be present inside the extinction chamber 1.

By way of example, the magnet support 7 is made of plastics material. As shown, a flux channeling element 6 is placed in contact with the magnet 5 and is likewise housed in the magnet support 7. The magnet 5 and the flux channeling element 6 are electrically insulated by the magnet support 7. By way of example, the flux channeling element 6 is made of mild steel. The flux channeling element may optionally have a laminated structure. The magnet support 7 includes engagement means 9, e.g. in the form of notches, that are to co-operate by engaging some or all of the splitter plates 2. The engagement of the magnet support 7 with the splitter plates 2 serves to hold the magnet 5 stationary relative to the splitter plates 2.

Figure 2:
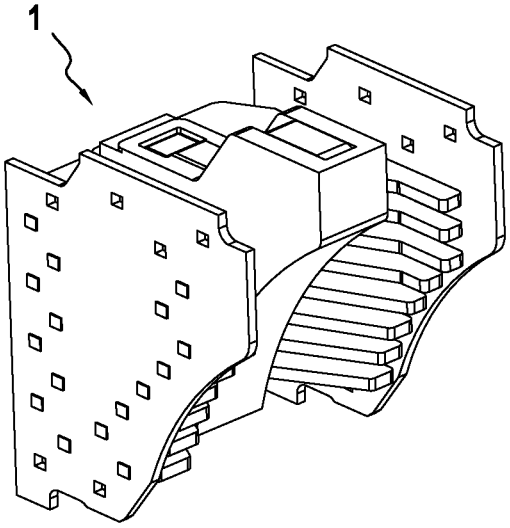
FIG. 2 shows the FIG. 1 extinction chamber in the assembled state.
Figure 3:
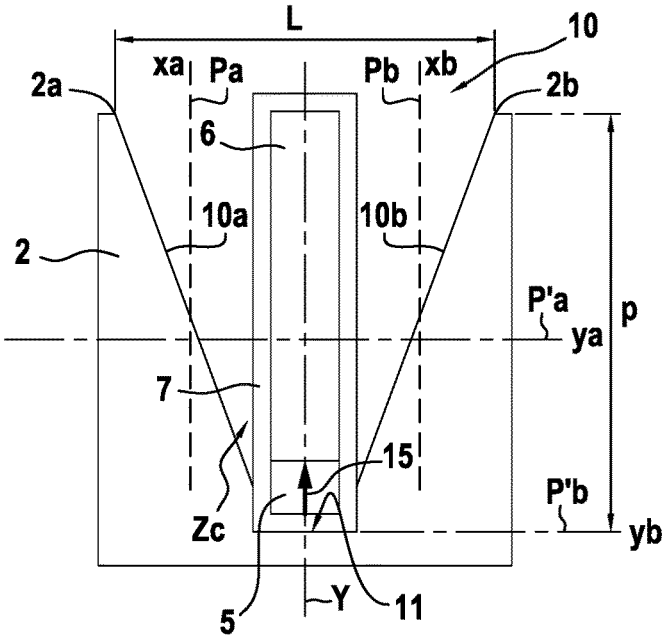
FIG. 3 is a section view of the extinction chamber of FIGS. 1 and 2, perpendicular on a plane to the height of the stack of splitter plates.

Once the magnet support 7 is fastened to the splitter plates 2 via the engagement means 9, the magnet 5 is present inside the extinction chamber 1 beside the back of the extinction chamber 1 and in its central zone $Z_c$ in the width direction of the extinction chamber 1, as shown in FIG. 3. FIG. 3 is a section view of the extinction chamber of FIGS. 1 and 2 on a plane perpendicular to the height of the stack of splitter plates 2. As shown, the splitter plates 2 are V-shaped when observed in a direction perpendicular to the planes in which they extend. In a variant, the splitter plates may be of some other shape, such as a U-shape, when observed in a direction perpendicular to the planes in which they extend. FIG. 3 marks the depth p of the extinction chamber 1 which corresponds to the distance between the inlet 10 of the extinction chamber 1 and the back 11 of the extinction chamber 1, as measured perpendicularly to the height h of the stack of splitter plates 2. There can also be seen the width L of the extinction chamber 1, where the width L is measured perpendicularly to the height h of the stack of splitter plates 2 and perpendicularly to the depth p of the extinction chamber 1. Unless specified to the contrary, the width L of the extinction chamber 1 corresponds to the inside width of the extinction chamber as measured between the ends 2*a* and 2*b* of the splitter plates 2. The magnetization M of the magnet 5 (represented by arrow 15 in FIGS. 1 and 3) presents a non-zero component along an axis Y extending between the inlet 10 and the back 11 of the extinction chamber (also referred to as the depth axis Y of the extinction chamber 1). In particular, the magnetization M may lie in the planes in which the splitter plates 2 extend. The magnetization M may be directed substantially solely along the depth axis Y of the extinction chamber 1. The magnetization M is shown as being directed towards the inlet 10 of the extinction chamber 1, however it would not go beyond the ambit of the invention for the magnetization to be directed towards the back 11 of the extinction chamber 1. As shown, the magnet 5 is present in a central zone $Z_c$ in the width direction of the extinction chamber 1. In other words, the magnet 5 is present in a zone defined by planes $P_a$ and $P_b$ having respective equations $x_a$=0.25L and $x_b$=0.75L, where L is the width of the extinction chamber 1 and where $x_a$ and $x_b$ are measured along the width L of the extinction chamber 1, taking one of the ends 2*a* or 2*b* of the splitter plates 2 as the origin. By way of example, the magnet may be present in a zone defined by planes $P_a$ and $P_b$ having respective equations $x_a$=0.40L and $x_b$=0.60L.

In addition, the magnet 5 is situated beside the back 11 of the extinction chamber, i.e. it is closer to the back 11 of the extinction chamber 1 than is the inlet 10 of the extinction chamber 1. In other words, the magnet 5 is present in a zone defined by planes $P'_a$ and $P'_b$ having respective equations $y_a$=0.5p and $y_b$=p, where p designates the depth of the extinction chamber 1 and where $y_a$ and $y_b$ are measured along the depth of the extinction chamber 1 and take one of the ends 2*a* or 2*b* of the splitter plates 2 as the origin. By way of example, the magnet 5 may be present in a zone defined by planes $P'_a$ and $P'_b$ having respective equations $y_a$=0.7p and $y_b$=p.

In particular, the magnet 5 does not extend along the lateral edges 10*a* and 10*b* of the extinction chamber 1. In addition, in the example shown, the magnet 5 is situated entirely in the central zone $Z_c$ and beside the back 11 of the extinction chamber 1.

Figure 4:
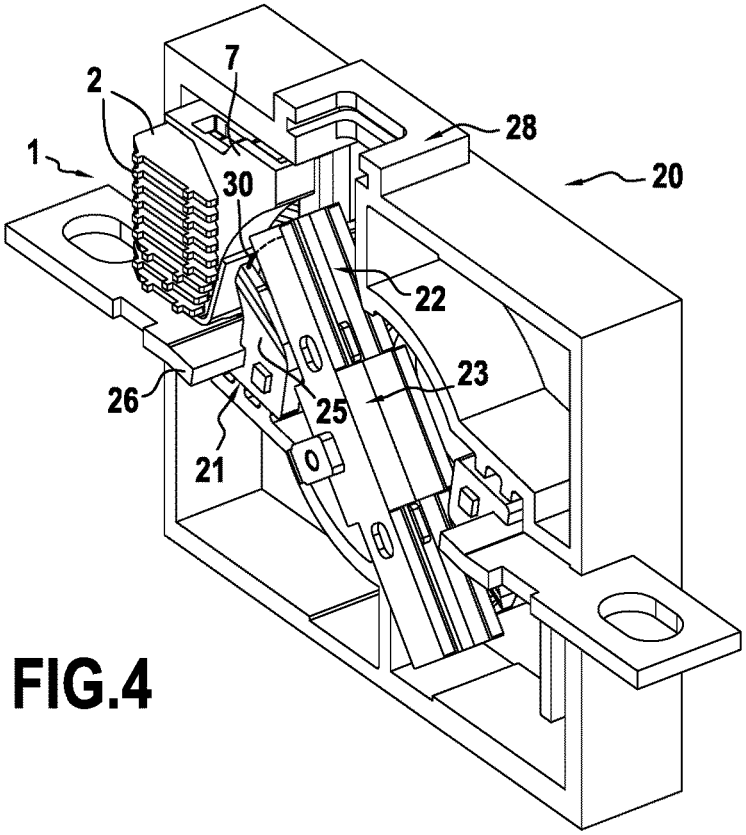
FIG. 4 shows a circuit breaker device of the invention.

FIG. 4 shows a circuit breaker device 20 of the invention including an extinction chamber 1 as described with reference to FIGS. 1 to 3. The breaker device 20 shown in FIG. 4 is a double-break rotary breaker device with blades. The breaker device 20 has a contact zone 21 in which movable contacts 22 present on compensation sheets 23 can be put into contact with and separated from a stationary contact head 25, which is secured to a stationary support 26. The contact head 25 and the stationary support 26 form a stationary subassembly enabling the breaker device 20 to be connected in an electrical installation. The stationary contact 25 is present facing a single extinction chamber 1. The contact head 25 may be made of metal material, e.g. copper. When the movable contacts 22 are in contact with the contact head 25, electric current can flow between these elements. When the movable contacts 22 are separated from the contact head 25, current can no longer flow between these elements.

The outer housing of the breaker device 20 is constituted by a box 28 corresponding to the combination of two half-boxes. FIG. 4 also shows the electric arc 30 formed between the movable contacts 22 and the contact head 25 when these elements separate. In variants that are not shown it is possible to use a pressure breaker device or a single-break device, with a butt or sliding contact. It is also possible to use a breaker device with blades that move in translation.

Figure 5:
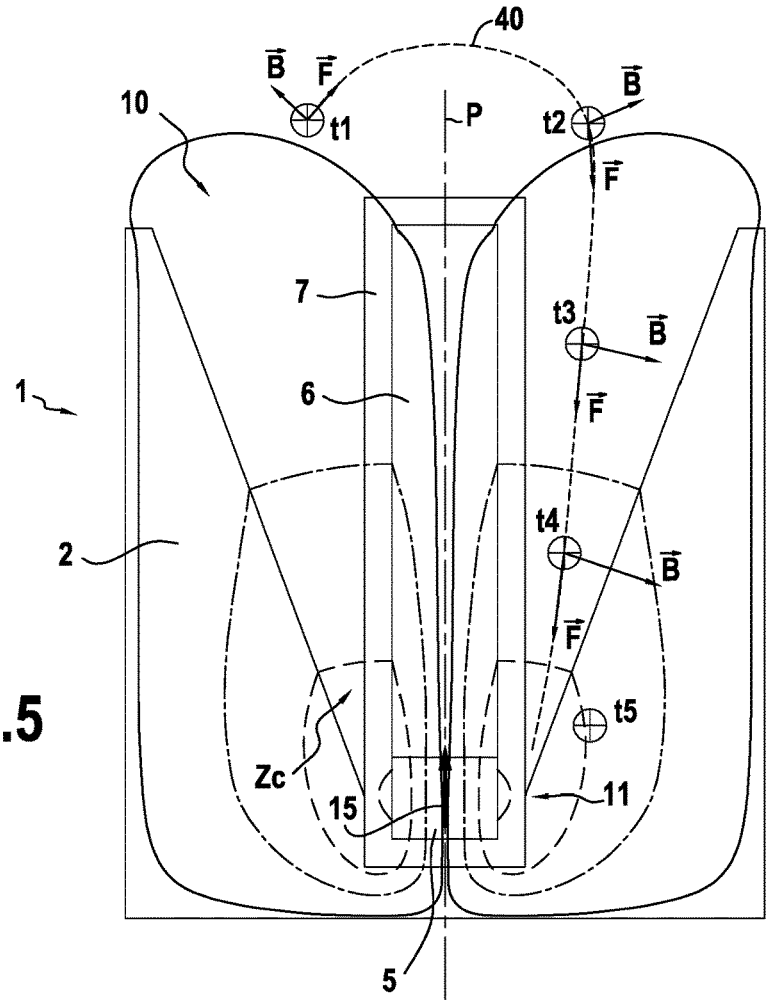
FIG. 5 is a two-dimensional (2D) view of the magnetic field lines created by the magnets in the extinction chamber of FIGS. 1 to 3.

FIG. 5 is a 2D view of the magnetic field lines that are created by the magnet in the extinction chamber 1 as described with reference to FIGS. 1 to 3. This 2D view is a section view on a plane perpendicular to the height of the stack of splitter plates 2. In order to make the figure more easily readable, only a few magnetic field lines are shown. The intensity of the magnetic field generated by the magnet 5 increases on going from the inlet 10 of the extinction chamber 1 towards the back 11 of the extinction chamber 1 (the magnetic field lines are closer together).

There follows a description of the effect of such an extinction chamber 1 on an electric arc formed in a contact zone situated facing the inlet 10 of the extinction chamber 1. The extinction chamber shown serves to extinguish an electric arc in air.

In FIG. 5:

- arrows referenced $\vec{B}$ designate the local magnetic field induced by the magnet 5 on the electric arc;
- arrows referenced $\vec{F}$ designate the Laplace (or Lorentz) force acting on the arc as a result of the magnetic field from the magnet 5 (F_Laplace_magnet=J×B). F_Laplace_magnet increases as the arc penetrates further into the extinction chamber 1; and
- the direction of the current flowing in the arc goes towards the back of the plate, as shown in FIG. 5.

At an instant t1, the arc is present between the stationary movable contacts facing the inlet 10 of the extinction chamber 1. Two initial positions are possible: on the right or on the left of the plane of symmetry P, depending on the instant at which the first arc appears when the contacts separate. The extinction chamber 1 is symmetrical about the plane P of equation x=0.5L where, as explained above, L is the width of the extinction chamber 1, and x is measured along the width L of the extinction chamber 1, taking one of the ends 2*a* or 2*b* of the splitter plates 2 as the origin. Once such an extinction chamber is incorporated in a breaker device as described below, the plane P intersects the contact zone in which the stationary contact is present.

The arc is then deflected towards another position because of the application of the Laplace force produced by the magnetic field generated by the magnet 5 (see position t2). As mentioned above, it is observed that between the position t1 and the position t2 the arc is deflected with a non-zero shift component across the width of the extinction chamber (non-zero component along the axis of rotation of the movable contact when using a rotary movable contact) as a result of the presence of the permanent magnet 5 in the extinction chamber 1.

Thereafter, the arc enters into the extinction chamber 1 (see positions t3 and t4) and accelerates into the extinction chamber 1, in particular between the positions t3 and t4. The lengthening of the arc serves advantageously to increase the voltage of the arc before it is split in the extinction chamber 1. The magnet 5 may be configured to accelerate the arc over at least 50% of the depth p of the extinction chamber 1. Once the arc has penetrated into the extinction chamber 1, the arc is moving mainly in the depth direction of the extinction chamber 1, as shown in FIG. 5.

At the instant t5, the arc reaches the splitter plates 2 and is split in the extinction chamber 1. This splitting serves to stabilize the arc and also to cool it. Its cooling further increases the impedance of the arc, thereby generating an even greater arc voltage.

The arc is also subjected to a force other than the Laplace force due to the magnetic field of the magnet 5, this other force being produced because of the presence of the splitter plates (the "voltage swallowing" effect of the splitter plates). This force is not shown in FIG. 5, but is additional to the force produced by the magnet and it also contributes to moving the arc.

The dashed-line curve 40 corresponds to the path followed by the electric arc while it is being deflected and attracted by the extinction chamber 1. As shown, the Laplace force exerted on the arc as a result of the presence of the magnet 5 enables the arc to be deflected towards the back 11 of the extinction chamber 1 and towards the central zone $Z_c$ in the width direction of the extinction chamber 1.

The extinction chamber of the invention can be used for breaking DC or AC. The extinction chamber of the invention can be used in the low voltage range (U_AC≤1000V and U_DC≤1500V), and also in the medium voltage range (U_AC≤50,000V and U_DC≤75,000V).

Figure 6A:
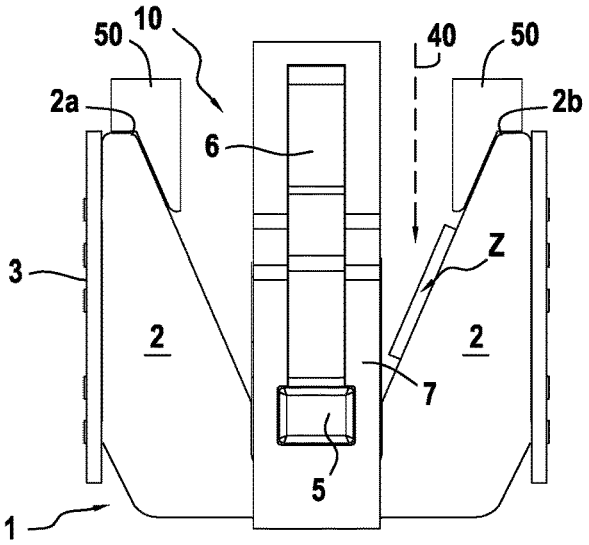
FIGS. 6A and 6B show variant embodiments of extinction chambers of the invention.
Figure 6B:
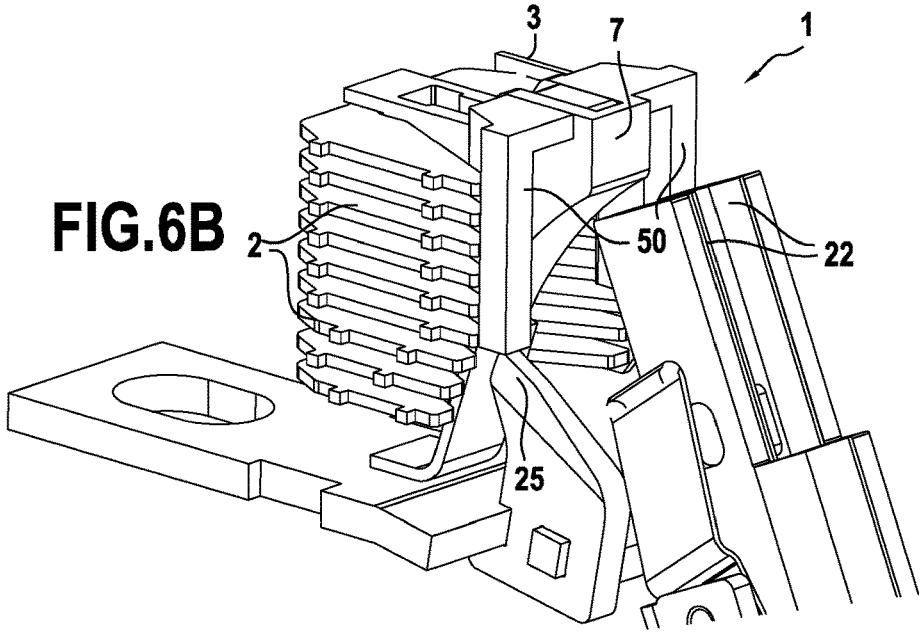

FIGS. 6A and 6B show variant embodiments of extinction chambers of the invention.

In the variant shown in FIGS. 6A and 6B, the extinction chamber 1 has a plurality of electric arc guide cheeks 50. These guide cheeks 50 are made of an electrically insulating material and they are situated at the inlet 10 of the extinction chamber 1, covering the ends 2*a* and 2*b* of the splitter plates 2 in full or in part.

As explained above, the guide cheeks 50 serve to prevent the arc from attaching to the ends 2*a* and 2*b* of the splitter plates 2, and thus to improve extinction performance. The dashed-line curve 40 corresponds to the path followed by an electric arc in such an extinction chamber. As shown, by using an extinction chamber 1 having guide cheeks 50, the arc does not attach to the ends 2*a* and 2*b* of the splitter plates and is attracted towards the back 11 of the extinction chamber 1 and towards a splitting zone Z.

In the variant shown in FIG. 6B, the guide cheeks 50 are secured to the magnet support 7, and for example may be integral therewith.

Figure 7A:
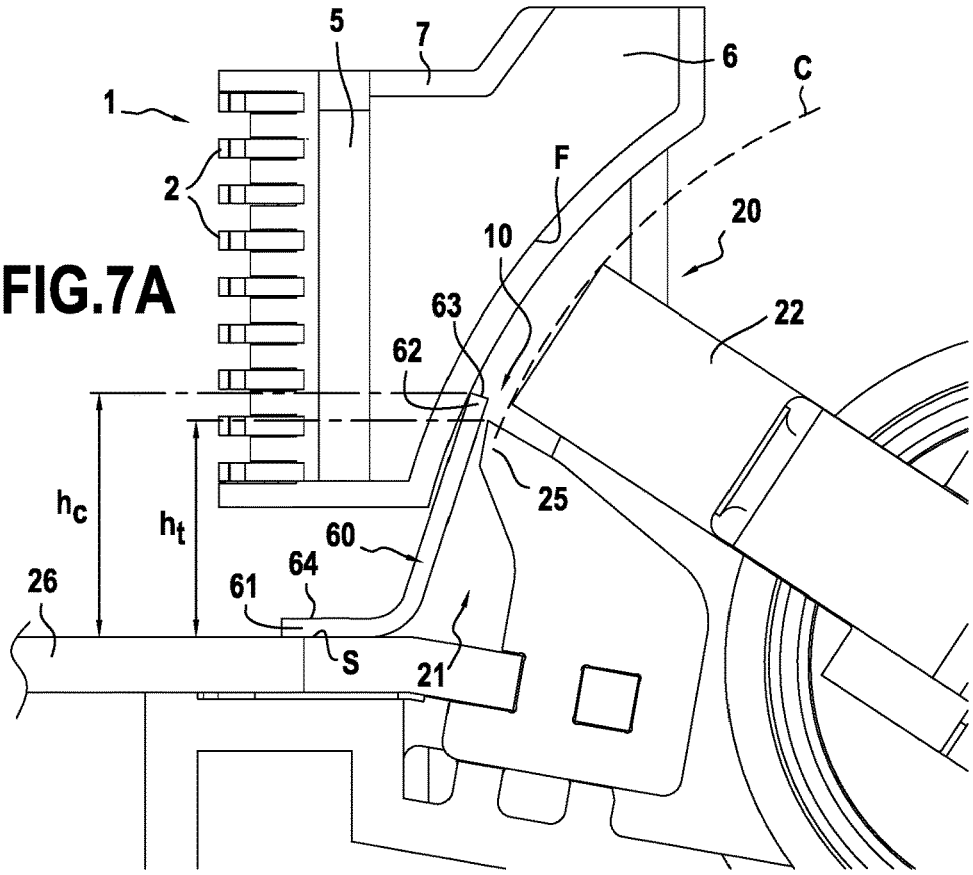
FIGS. 7A to 7D show the use of an arcing horn in a breaker device of the invention.

FIG. 7A shows the use of an arcing horn 60 that is suitable for use in the breaker device 20 of the invention, and serving to make it easier to cause the electric arc to enter into the extinction chamber 1.

The arcing horn 60 is placed facing the contact head 25 on the stationary support 26 at the inlet 10 of the extinction chamber 1. The arcing horn 60 is fastened to the stationary support 26 by a mechanical connection. The arcing horn 60 comprises a tab 61 together with an arc-switching portion 62. The arcing horn is made of an electrically conductive material, e.g. a metal material, such as steel. In the example shown, the tab 61 is in contact with the stationary support 26, but it would not go beyond the ambit of the invention for the arcing horn 60 not to be in contact with the stationary support 26, but to be fastened to the box constituting the outer housing of the breaker device 20. Under such circumstances, the distance between the arcing horn 60 and the stationary support 26 may be less than or equal to 1 millimeter (mm), for example. An electric arc generated from the movable contacts 22 moves along the arc switching portion 62. Such movement along the arc switching portion 62 serves to facilitate entry of the arc into the extinction chamber 1. The arcing horn 60 also includes a stationary surface 64 corresponding to the surface of the tab 61 that is remote form the stationary support 26. In the example shown, the height $h_c$ of the arcing horn (corresponding to the height at which the end 63 of the switching portion 62 is located) is greater than the height $h_t$ of the contact head. The heights $h_c$ and $h_t$ are measured from the surface S of the stationary support 26 faced by the arcing horn and they are measured perpendicularly to this surface S. In variants that are not shown, the height of the arcing horn may be equal to or less than the height of the contact head.

Figure 7B:
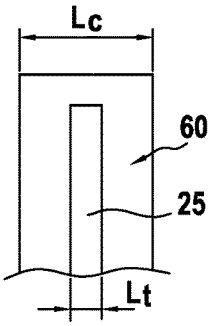

As shown in FIG. 7B, the width $L_c$ of the arcing horn 60 is greater than the width $L_t$ of the contact head 25. This characteristic is important since, in the example shown, when the contacts separate, the arc that is generated tends to be deflected with a non-zero component along the axis of rotation of the movable contact because of the presence of the permanent magnet 5. The use of a wide arcing horn 60 thus makes it possible for the arc that is deflected along the axis of rotation to "attach" to the arcing horn 60. In the example shown, after the arc has been generated as a result of the contacts being opened, the arc is initially deflected along the axis of rotation of the movable contact (axial deflection) and the arc is then deflected along the depth of the extinction chamber (radial deflection).

Unless specified to the contrary, the widths $L_c$ and $L_t$ of the arcing horn and of the contact head are measured perpendicularly to their height and while looking directly into the inlet of the extinction chamber.

Figure 7C:
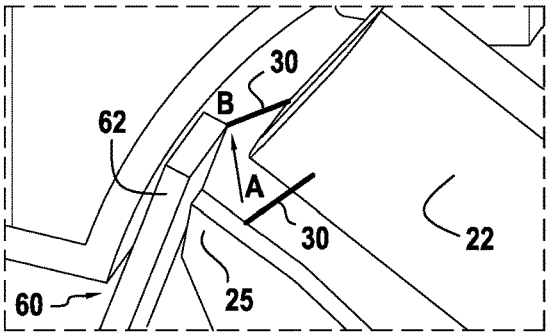

After the contacts have opened, the arc 30 switches onto the switching portion 62 (the arc passes from the configuration A to the configuration B, see FIG. 7C). With a floating arcing horn, another arc can be created in series between the stationary support and the arcing horn, immediately behind the contact head, i.e. between the tab and the stationary support.

In any event, by moving the arc 30 into configuration B, using an arcing horn 60 makes it possible to facilitate entry of the arc 30 into the extinction chamber 1. The presence of an arcing horn thus improves the circuit-breaking performance by increasing the voltage of the arc more rapidly and consequently leading to more rapid breaking of the circuit.

Figure 7D:
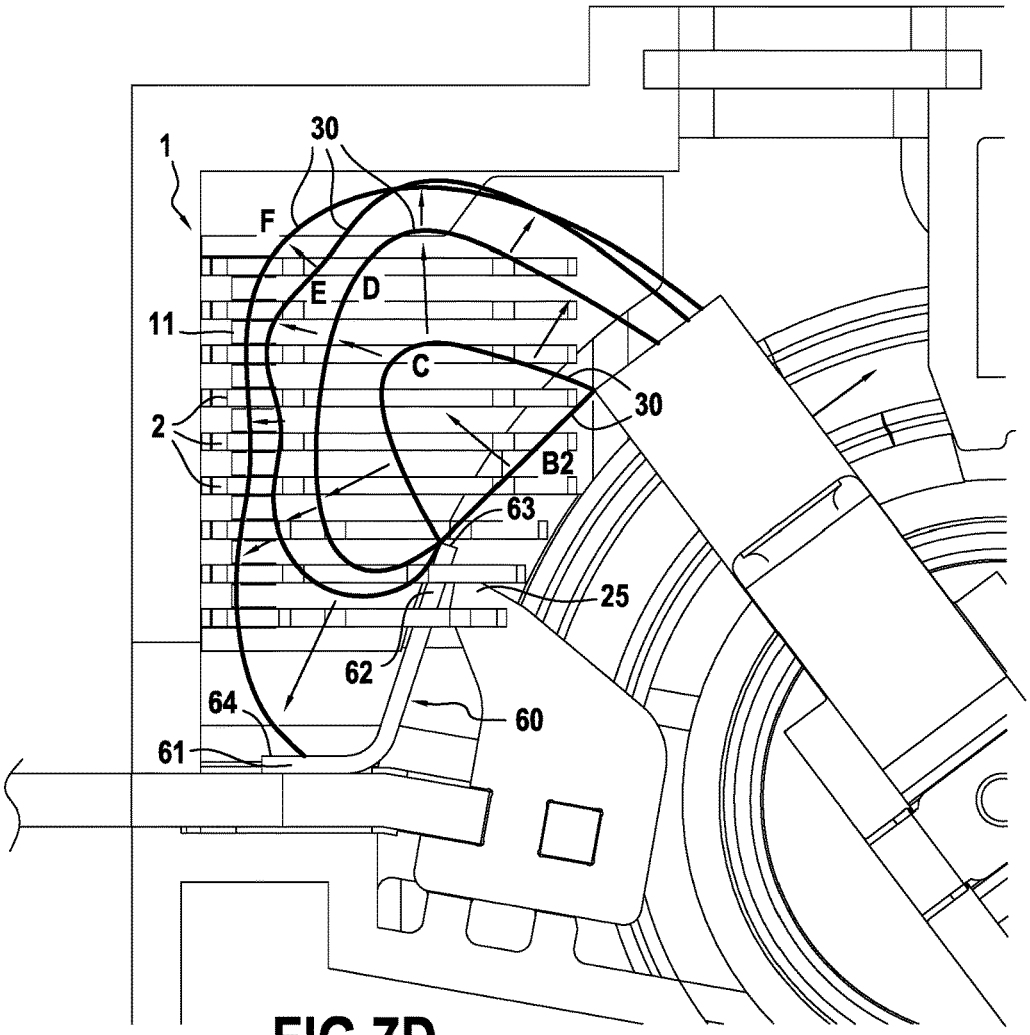

After switching the arc 30 onto the arcing horn 60, the movable contacts 22 continue their opening movement and the arc lengthens in the extinction chamber 1. This variation over time in the shape of the arc is shown in FIG. 7D, which is described below.

The arc 30 is initially in a configuration B2, i.e. it is present between the switching portion 62 and the movable contacts 22. The arc 30 then passes into a configuration C in which it is present in the extinction chamber 1 and is attracted towards the back 11 of the chamber 1 by the combination of the Laplace force from the magnetic field of the magnet and the Laplace force from its own shape, due to its own current (loop effect) and due to the surrounding magnetic parts (the "voltage swallowing" effect of the splitter plates 2). The further the arc 30 enters into the chamber 1 the more it is attracted towards the back 11 of the extinction chamber 1, since the magnitude of the Laplace forces acting on it increases. This behavior is represented by the arc shown in a configuration D in FIG. 7D. The arc then attaches to the splitter plates 2, at the back of the extinction chamber (configuration E). Thereafter, the Laplace force pushes the arc for switching from the end 63 of the switching portion 62 onto the stationary surface 64, thereby causing the arc to attach to the splitter plates 2, thereby enabling it to be stabilized in the extinction chamber 1.

FIG. 7A also shows another advantageous characteristic of the present invention. In the example shown in FIG. 7A, the movable contact 22 moves in rotation about an axis of rotation when the contacts 22 and 25 are separated. In this example, the axis of rotation is perpendicular to the plane of the plate. The flux channeling element 6 present inside the extinction chamber 1 presents a face F facing towards the contact zone 21 that, when the element 6 is observed in a plane perpendicular to the axis of rotation, presents the same shape as the path C followed by the movable contact 22 during separation of the contacts 22 and 25, i.e. a circularly arcuate shape. As explained above, such a configuration serves advantageously to further improve the attraction of the arc into the extinction chamber.

As mentioned above, the arcing horn makes it possible to assist splitting the electric arc by making it easier for it to approach the back of the extinction chamber.

Figure 8A:
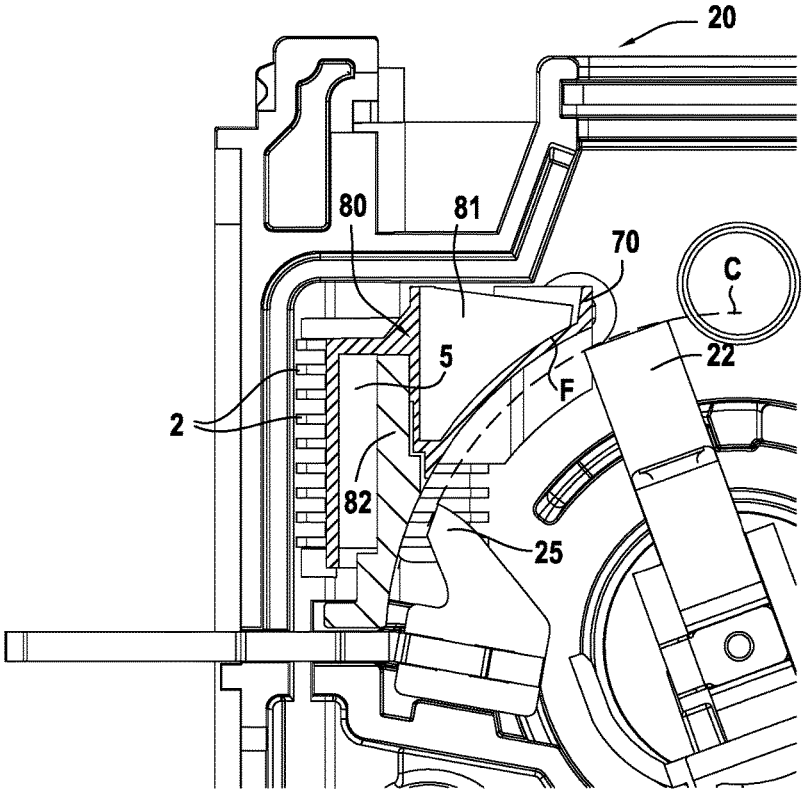
FIGS. 8A and 8B show variant embodiments of extinction chambers including a two-part flux channeling element.
Figure 8B:
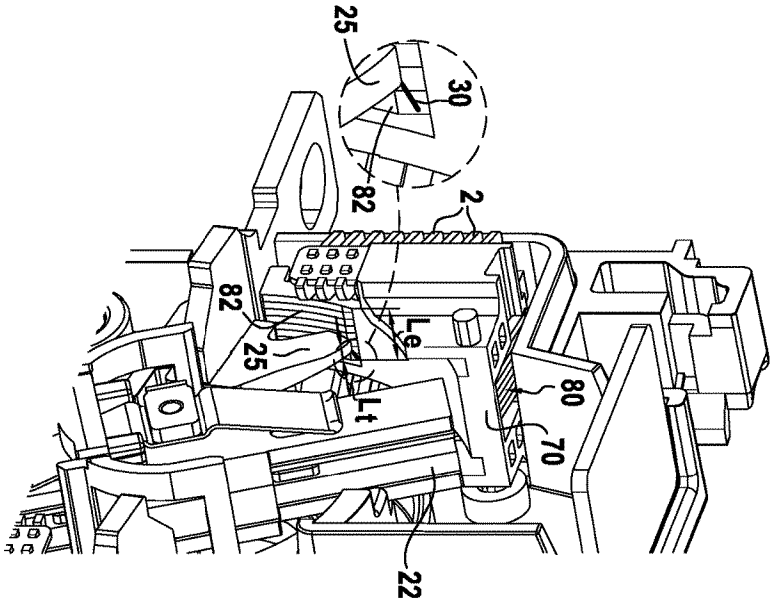

FIGS. 8A and 8B show a variant embodiment in which the extinction chamber 1 has a two-part flux channeling element 80 present therein. The flux channeling element 80 has a first part constituted by an arc switching element 82 that is electrically conductive, and a second part constituted by an additional flux channeling element 81 present in an electrically insulating channeling element support 70. In the example shown, the magnet 5 is housed in the channeling element support 70. In the example shown, the magnet 5 is mounted via the bottom of the support 70. The support 70 serves to protect the magnet from the electric arc. The magnet 5 can thus be housed in the channeling element support 70 (as described with reference to FIGS. 8A and 8B) or else in the magnet support 7, e.g. as described with reference to FIG. 1.

As shown, the arc switching element 82 is present facing the stationary contact 25 and it presents a width $L_e$ that is greater than the width $L_t$ of the stationary contact 25. The width $L_e$ is measured in the same manner as that described above for the widths $L_t$ and $L_c$. As explained above for the arcing horn, the fact that the switching element 82 is wider than the stationary contact head 25 enables an electric arc generated between the contacts 22 and 25 to switch onto the arc switching element 82. In the element shown, the flux channeling element 80 serves advantageously to perform both the magnetic flux channeling function and the function of assisting switching of the arc.

This system thus enables the arc to switch onto the arc switching element 82 because of its attraction into the extinction chamber 1 by the effect of the magnetic field generated by the magnet 5. As shown, the arc 30 moves the stationary contact head 25 towards the arc switching element 82. Thereafter, the arc switches finally into the extinction chamber 1 where it is split, as described in detail above.

The use of such a two-part flux channeling element 80 presents the advantages described above for an arcing horn in terms of attracting the arc into the extinction chamber and reducing erosion of the contact head due to the arc.

In the same manner as that described above, in the example shown in FIGS. 8A and 8B, the flux channeling element 80 has face F situated beside the contact zone that, when the flux channeling element 80 is observed in a plane perpendicular to the axis of rotation of the movable contact 22, presents the same shape as the path C followed by the movable contact 22 while the contacts 22 and 25 are separating.

The term "including/containing/comprising a" should be understood as "including/containing/comprising at least one".

The term "lying in the range . . . to . . . " should be understood as including the bounds.

The invention claimed is:

1. An electric arc extinction chamber comprising:

a stack of electric arc splitter plates, the splitter plates defining an inlet of the extinction chamber that is to be present facing electric contacts, and a back of the extinction chamber; and at least one permanent magnet arranged inside the extinction chamber in a central zone in a width direction of the extinction chamber and beside the back of the extinction chamber, wherein the extinction chamber defines an axis extending between the inlet of the extinction chamber and the back of the extinction chamber, and the magnet presents magnetization having a component that extends along said axis of the extinction chamber.

2. The chamber according to claim 1, wherein the magnet is held in an electrically insulated magnet support.

3. The chamber according to claim 2, wherein the magnet support is assembled by engagement with one or more splitter plates.

4. The chamber according to claim 1, further comprising a flux channeling element present inside the extinction chamber.

5. The chamber according to claim 4, wherein the flux channeling element is held in the magnet support.

6. The chamber according to claim 1, wherein a single magnet is present inside the extinction chamber.

7. The chamber according to claim 1, wherein a plurality of permanent magnets are present inside the extinction chamber, at least one magnet of said plurality of magnets being present in the central zone in the width direction of the extinction chamber and beside the back of the extinction chamber.

8. The chamber according to claim 1, further comprising one or more electrically insulating electric arc guide cheeks, the guide cheeks being situated at the inlet of the extinction chamber and covering the ends of the splitter plates in full or in part.

9. The chamber according to claim 1, wherein said chamber is symmetrical about a plane of equation $x=0.5L$, where L designates the width of the extinction chamber and where x is measured along the width L of the extinction chamber, taking one of the ends of the splitter plates as the origin.

10. A circuit breaker device comprising:

the extinction chamber according to claim 1; and a contact zone in which there are present at least one stationary contact and at least one movable contact that is movable relative to the stationary contact, the contacts being suitable for being put into contact with each other and for being separated from each other, the stationary contact being present facing the inlet of the extinction chamber.

11. The device according to claim 10, further comprising an arcing horn present facing the stationary contact, a width $L_c$ of the arcing horn being greater than a width $L_t$ of the stationary contact.

12. The device according to claim 11, wherein a height $h_c$ of the arcing horn is greater than or equal to a height $h_t$ of the stationary contact.

13. The device according to claim 10, wherein the movable contact is configured to move in rotation about an axis of rotation when the contacts are being separated, and wherein a flux channeling element is present inside the extinction chamber, the flux channeling element having a face situated beside the contact zone that, when the flux channeling element is observed in a plane perpendicular to the axis of rotation, presents a same shape as a path followed by the movable contact during separation of the contacts.

14. The device according to claim 10, further comprising a flux channeling element present inside the extinction chamber, at least a portion of the flux channeling element being constituted by an arc switching element present facing the stationary contact, a width $L_e$ of the arc switching element being greater than a width $L_t$ of the stationary contact.

15. The device according to claim 14, wherein the flux channeling element includes the arc switching element together with an additional flux channeling element present in an electrically insulating channeling element support.

16. The chamber according to claim 1, wherein the axis extending between the inlet of the extinction chamber and the back of the extinction chamber is a symmetric axis in the width direction of the extinction chamber.

17. The chamber according to claim 1, wherein the magnetization of the permanent magnet is directed substantially solely along the axis of the extinction chamber.

18. The chamber according to claim 1, wherein the magnet generates a magnetic field having, in a region wherein the permanent magnet is present, a component that extends along said axis of the extinction chamber.

19. The chamber according to claim 18, wherein an intensity of the component of the magnetic field increases along said axis on going from the inlet toward the back.

* * * * *